US007040300B2

(12) United States Patent
Jeong

(10) Patent No.: US 7,040,300 B2
(45) Date of Patent: May 9, 2006

(54) FUEL SUPPLY NOZZLE

(75) Inventor: Ji Hoon Jeong, Daejeon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/882,116

(22) Filed: Jun. 30, 2004

(65) Prior Publication Data

US 2005/0087179 A1 Apr. 28, 2005

(30) Foreign Application Priority Data

Oct. 22, 2003 (KR) ..... 10-2003-0073902

(51) Int. Cl.
*F02M 37/04* (2006.01)

(52) U.S. Cl. ..... 123/514

(58) Field of Classification Search ..... 123/514
See application file for complete search history.

(56) References Cited

U.S. PATENT DOCUMENTS

| | | | | |
|---|---|---|---|---|
| 4,503,885 | A * | 3/1985 | Hall | 137/574 |
| 5,285,759 | A * | 2/1994 | Terada et al. | 123/514 |
| 6,205,981 | B1 * | 3/2001 | Lorraine | 123/514 |
| 6,269,800 | B1 * | 8/2001 | Fischerkeller et al. | 123/514 |
| 6,415,771 | B1 * | 7/2002 | Mihatsch et al. | 123/514 |

FOREIGN PATENT DOCUMENTS

| | | |
|---|---|---|
| JP | 10-037504 | 10/1998 |

* cited by examiner

*Primary Examiner*—Thomas Moulis
(74) *Attorney, Agent, or Firm*—Morgan Lewis & Bockius LLP

(57) ABSTRACT

Noise from fuel returning to a cylinder and from bubbles contained in the returning fuel is reduced by positioning a nozzle with a plurality of penetration holes, each with much less sectional area than a flow sectional area for returning fuel. The nozzle is also equipped with a guide section installed to change the proceeding direction of the fuel passing through the penetration holes and the fuel return valve.

8 Claims, 5 Drawing Sheets

FUEL SUPPLY NOZZLE

CROSS-REFERENCE TO RELATED APPLICATIONS

This application claims priority of Korean Application No. 10-2003-0073902, filed Oct. 22, 2003, the disclosure of which is incorporated fully herein by reference.

TECHNICAL FIELD OF THE INVENTION

The present invention relates to a nozzle used for a fuel supply system of a vehicle and a fuel return valve employing the nozzle. More specifically, the nozzle reduces noise generated while returning fuel is falling and the noise occurs while bubbles contained in the returning fuel are broken within the cylinder of the Liquefied Petroleum Injection Engine.

BACKGROUND OF THE INVENTION

Typically, in a Liquefied Petroleum Injection Engine, the liquefied petroleum is injected into the engine by an injector. Any fuel that is remaining following injection is returned to the fuel cylinder through a return line. The liquefied petroleum has the property of easily evaporating, therefore, a large number of bubbles are easily formed in the fuel returned to the cylinder.

The bubbles cause noise generation when they break in the cylinder and, furthermore, when the returning fuel is falling if the nozzle of the fuel return valve is not immerged in the fuel inside the cylinder. Therefore, it would be advantageous to reduce the noise generated by the bubbles in the fuel.

SUMMARY OF THE INVENTION

According to a preferred embodiment noise generated by fuel returning into a cylinder is reduced by providing a nozzle for a fuel supply system of a vehicle and a fuel return valve employing the nozzle. The noise is generated from bubbles in the fuel breaking as the fuel returns to the cylinder.

In a preferred embodiment, the nozzle for the fuel supply system is composed of a nozzle body formed with a plurality of penetration holes of which the sectional area is about 40% or less of the flow sectional area of the returning fuel. A guide section is integrated into the nozzle body to change the proceeding direction of the fuel discharged from the penetration holes.

According to another embodiment, the fuel supply system includes a return nipple integrated into the valve body to receive a supply of returning fuel. The nozzle body is preferably formed with penetration holes of which the sectional area is 40% or less when compared to the flow sectional area of the fuel returning through the return nipple. The nozzle is preferably equipped with a guide section integrated into the nozzle body to change the proceeding direction of the fuel discharged from the penetration holes. The valve spool is installed in such a way that allows for straight line sliding or movement possible within the valve body.

In a preferred embodiment, a spring is installed to apply an elastic force to the valve spool, such as to allow only flow of the fuel streaming to the nozzle from the return nipple. Furthermore, a plunger delivers an elastic force of the spring to the valve spool and guides the straight line sliding motion of the valve spool.

BRIEF EXPLANATION OF THE DRAWINGS

For a better understanding of the nature and objects of the invention, reference should be made to the following detailed description, taken in conjunction with the accompanying drawings, in which.

DETAILED DESCRIPTION OF PREFERRED EMBODIMENTS

Figure 1:
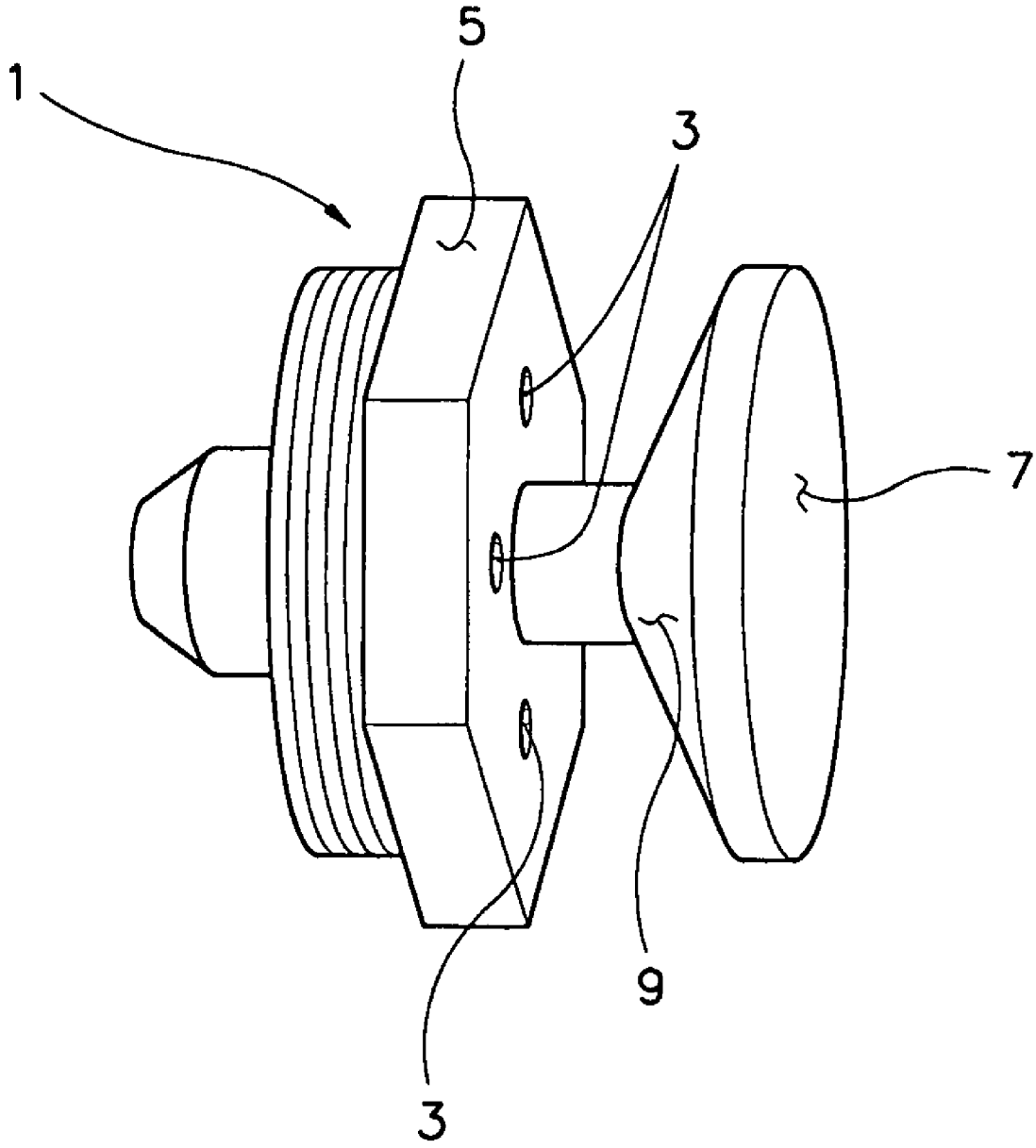
FIG. 1 is a perspective view of a nozzle for a fuel supply system of a vehicle according to an embodiment of the present invention.
Figure 2:
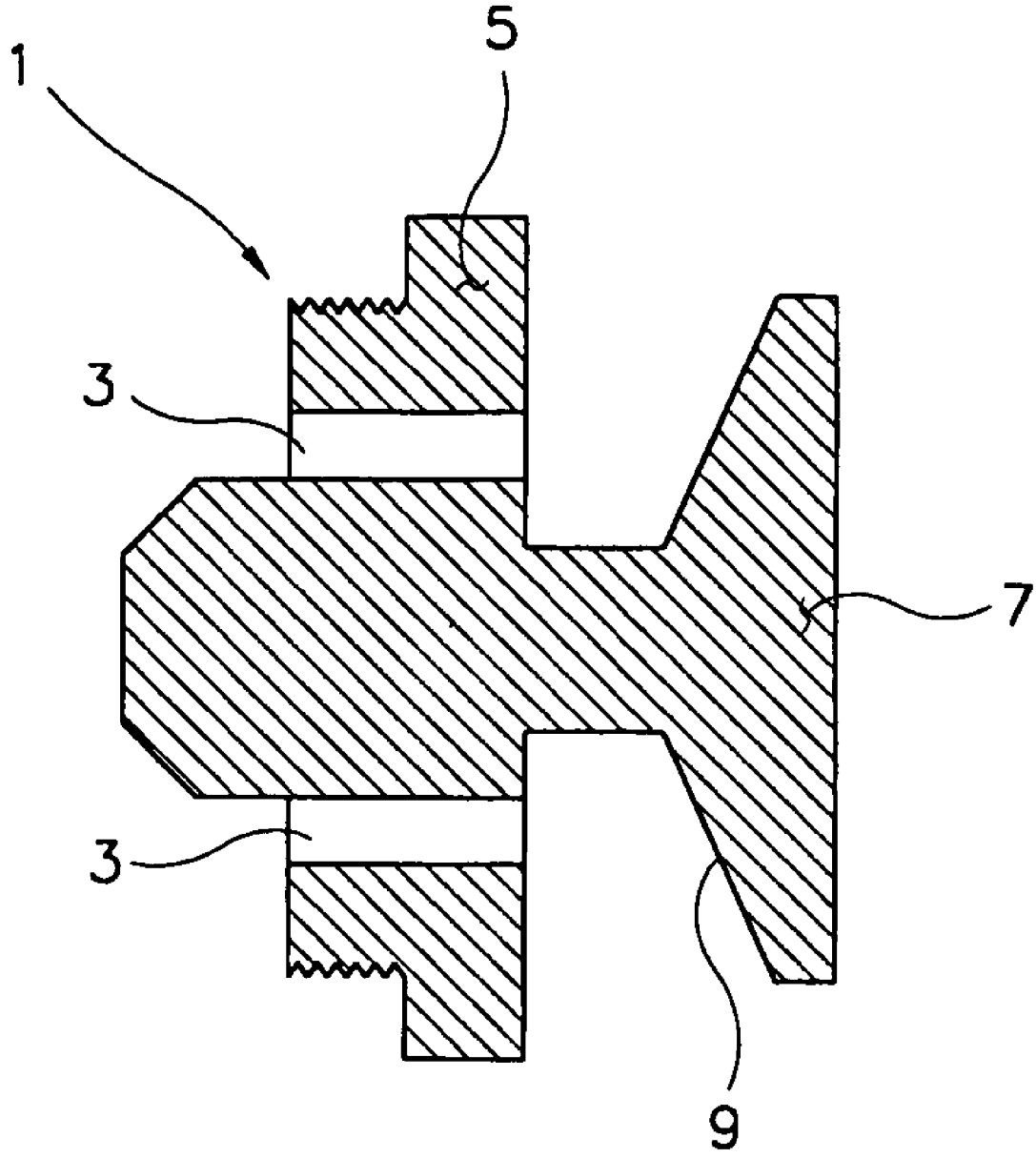
FIG. 2 is a cross-sectional view of the nozzle in FIG. 1.

Referring to FIGS. 1 and 2, a nozzle 1 is equipped with a nozzle body 5 formed with a plurality of penetration holes 3. A sectional area of each penetration hole 3 is about 40% or less of the flow sectional area of the returning fuel. A guide section 7 is integrated into the nozzle body 5 to change the proceeding direction of the fuel discharged from the penetration holes 3. As used herein, the flow sectional area of the returning fuel means the average sectional area of the passageway passed by the fuel when it is returned from injector to cylinder. The statement that the sectional area of the penetration holes 3 is about 40% or less of the flow sectional area of the returning fuel means that the individual penetration holes 3 are much smaller in size when compared to the flow sectional area. However, the number of the penetration holes 3 is determined such that the sum of the sectional area of all of the penetration holes 3 are larger than the flow sectional area of the returning fuel. For example, in the exemplary embodiment shown in the Figures, a nozzle is formed with four penetration holes 3, therefore, if each penetration hole 3 is 40% of the flow sectional area of the returning fuel, the sum of the four penetration holes 3 is roughly 1.6 times (60%) larger than the sectional area of the returning fuel.

According to the embodiment shown in the Figures, the penetration holes 3 are placed in parallel with each other in the length direction thereof. The guide section 7 is located in the center of the penetration holes 3 and the guide section 7 is provided with a slope 9. The slope 9 slants to the straight line proceeding direction of the fuel discharged through the penetration holes 3. In other words, the slope 9 is formed by providing the guide section 7 in a cone shape. The sectional area of the cone shape increases along a straight line proceeding direction of the fuel discharged through the penetration holes 3 from the nozzle body 5.

The fuel mass in vapor included in the returning fuel gets smaller in size when it passes through the penetration holes 3. Therefore, when the nozzle 1 is immerged in liquefied fuel, the fuel mass in vapor discharged from the nozzle 1 forms relatively small bubbles. The noise released from the small bubbles is very low even when they are broken. If the nozzle 1 of the present invention is used, the noise occurring in the cylinder can be greatly reduced in comparison with the noise occurring when the fuel mass in vapor included in the returning fuel is discharged without being reduced in size, such that large bubbles are broken open.

On the other hand, when the nozzle 1 is not immerged in liquefied fuel, the troublesome noise occurs when the fuel falls in the cylinder as liquefied fuel rather than when the bubbles are broken. The nozzle 1 not only reduces the noise occurring when the returning fuel falls in the cylinder as liquefied fuel by having the returning fuel pass through the penetration holes 3, thus reducing the size of fuel mass, but also the guide section 7 prevents the fuel from directly falling from the penetration holes 3 as liquefied fuel. In other words, the fuel passing through the penetration holes 3 falls with the kinetic energy reduced by the change of direction by the slope 9 and thus the noise is reduced further in comparison with the case where the fuel falls directly from the penetration holes 3 to the fuel in liquefied form. The guide section 7 formed as a cone shape, as describe above, doesn't just simply change the movement direction of the fuel coming from the penetration holes 3 but can reduce the falling noise by dispersing the fuel into cone shape.

Figure 3:
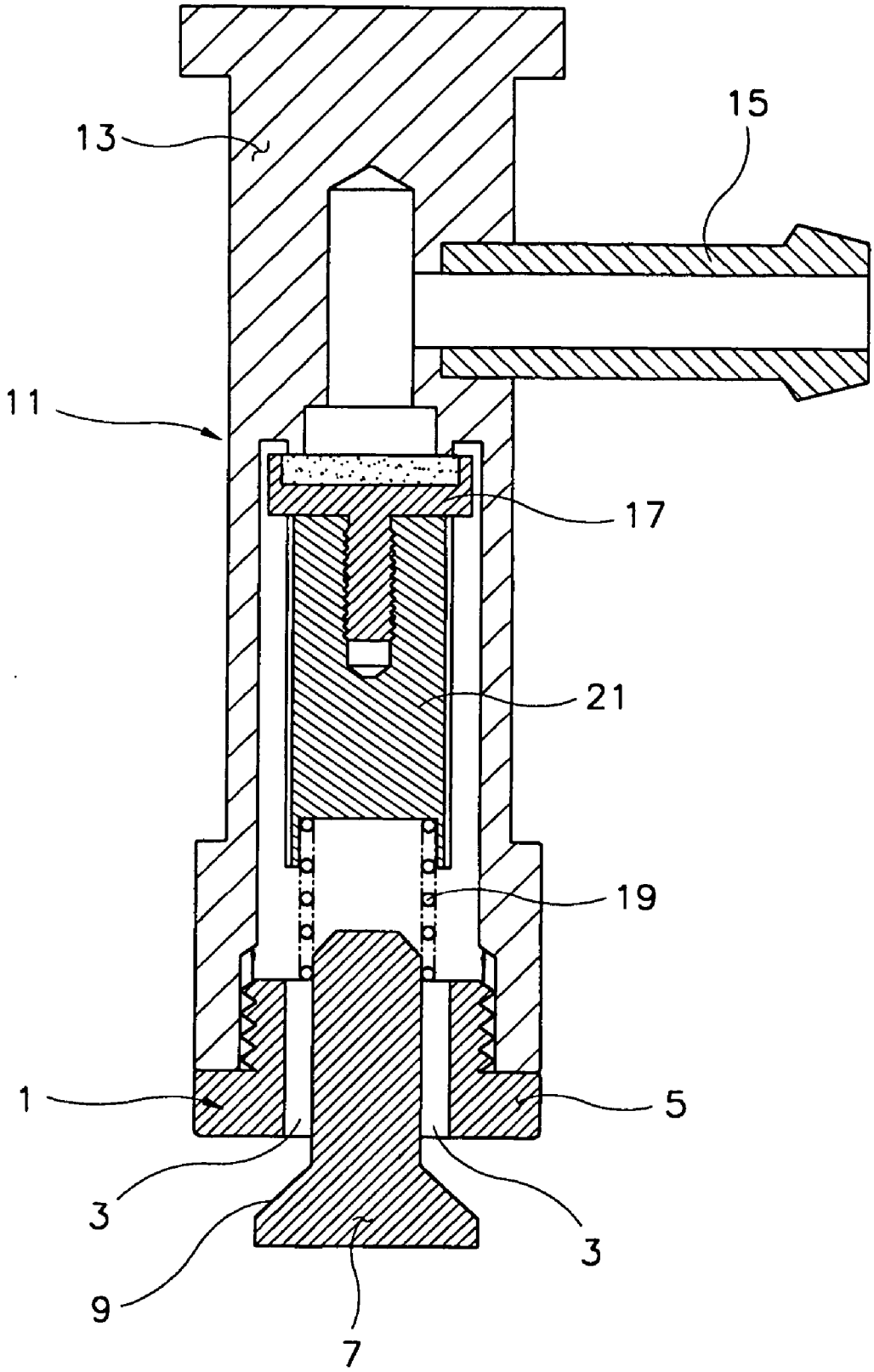
FIG. 3 is a cross-sectional view of a fuel return valve employing the nozzle in FIG. 1.
Figure 4:
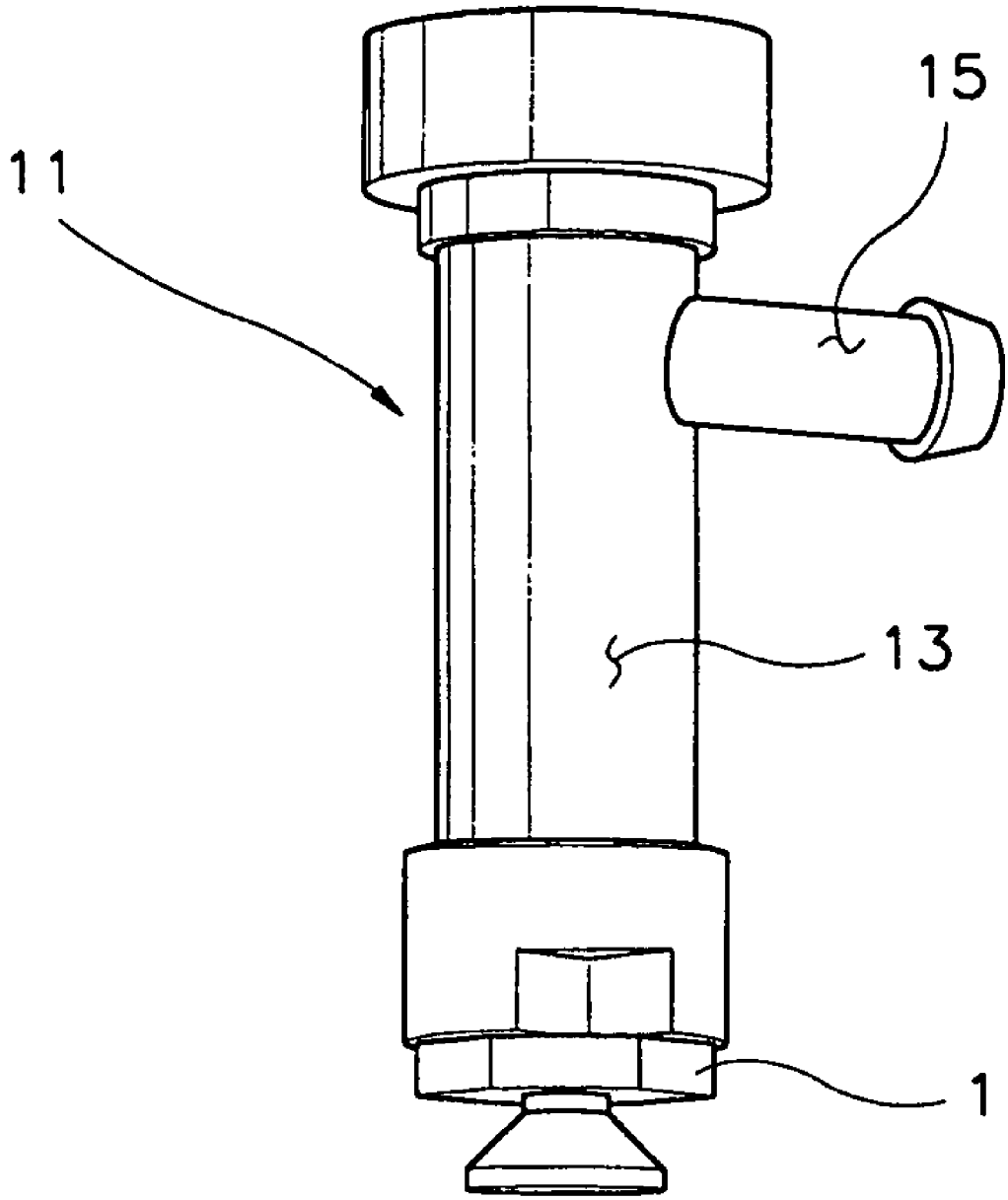
FIG. 4 is an external view of the fuel return valve in FIG. 3.
Figure 5:
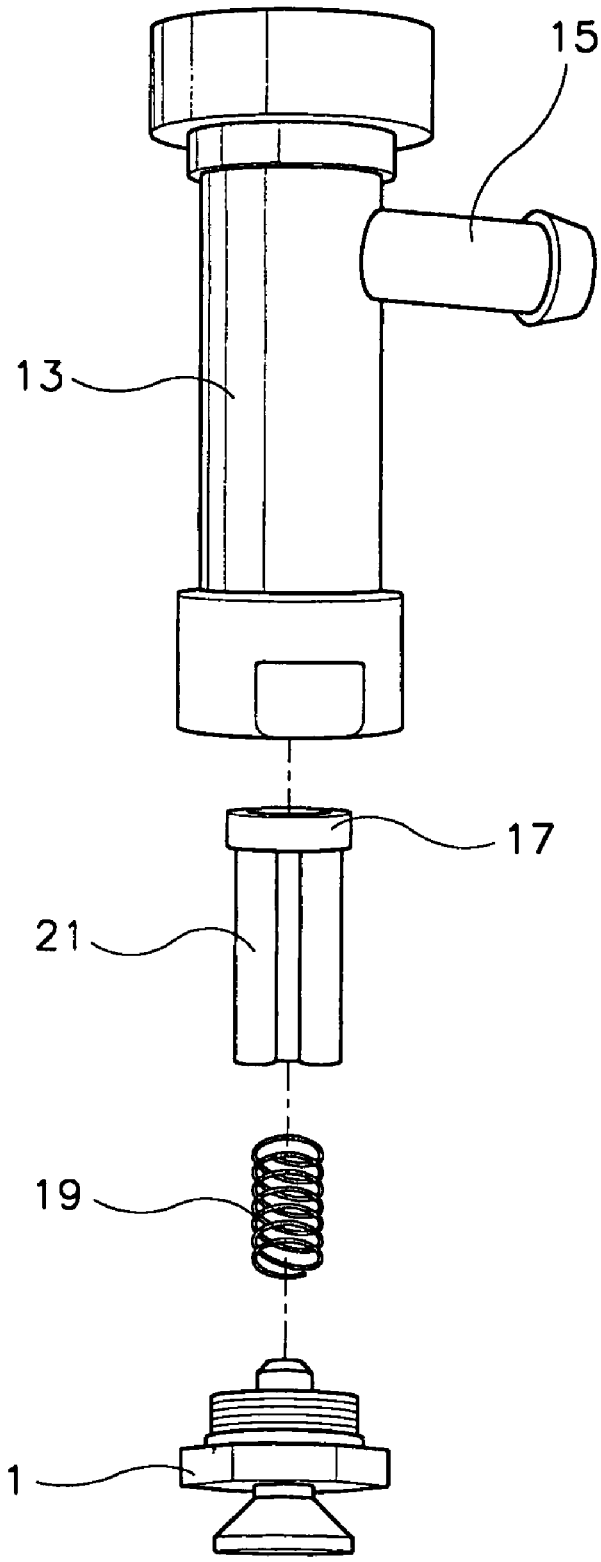
FIG. 5 is a perspective view of the disassembled parts of the fuel return valve of FIG. 4.

Referring to FIGS. 3–5, the fuel return valve 11 employing the nozzle 1 comprises a valve body 13 and a return nipple 15 integrated into the valve body 13 to receive a supply of returning fuel. The nozzle body 5 is formed with individual penetration holes 3 each having a sectional area that is about 40% or less when compared to the flow sectional area of the fuel returning through the return nipple 15. Other small size holes may be used in different numbers, the goal being to break up the total flow into numerous smaller streams.

The nozzle 1 is equipped with a guide section 7 integrated into the nozzle body 5 to change the direction of fuel discharged from the penetration holes 3. A valve spool 17 is installed such that a straight sliding line is formed within the valve body 13. A spring 19 installed to allow only the flow of fuel streaming to the nozzle 1 from the return nipple 15 by applying an elastic force to the valve spool 17. A plunger 21 delivers the elastic force of the spring 19 to the valve spool 17 and guides the straight line sliding motion of the valve spool 17.

The fuel return valve 11 allows the fuel to be discharged into the cylinder through the nozzle 1 if the pressure of the fuel returned through the return nipple 15 from the injector overcomes the force of the spring 19 and pushes the valve spool 17 and plunger 21.

The penetration holes 3 of the nozzle 1 and the guide section 7 contribute to the reduction of noise generated by the bubbles in case that the nozzle 1 is immerged in liquefied fuel in the cylinder and reduce noise generated when the fuel falls on the fuel in case when the nozzle 1 is not immerged in liquefied fuel in the cylinder.

It will be appreciated by one of ordinary skill in the art that modifications and alterations can be adapted to the preferred embodiments thus described, however, the scope of the invention is to be defined and interpreted by the appended claims.

What is claimed is:

1. A nozzle for a fuel supply system of a vehicle, comprising:

a nozzle body formed with a plurality of penetration holes in which each has a sectional area that is reduced as compared to a flow sectional area for returning fuel upstream of said holes, wherein the number of said holes is selected, based on the hole sectional area, to provide a total area greater than said flow sectional area; and a guide section integrated into said nozzle body configured to change a proceeding direction of fuel discharged from said penetration holes.

2. A fuel return valve for a fuel supply system of a vehicle, comprising:

a valve body;

a return nipple integrated into said valve body to receive a supply of returning fuel;

a nozzle body formed with a plurality of penetration holes wherein each hole has a cross-sectional area less than a flow sectional area of fuel returning through said return nipple, the nozzle equipped with a guide section integrated into said nozzle body to change a proceeding direction of fuel discharged from said penetration holes;

a valve spool installed in a way that makes straight line sliding possible within the valve body;

a spring installed to allow only a flow of fuel streaming to said nozzle from said return nipple by applying an elastic force to said valve spool; and a plunger that delivers the elastic force of the spring to the valve spool and guides the straight line sliding motion of said valve spool.

3. The fuel return valve according to claim 2, wherein the penetration holes of said nozzle are placed in parallel with each other in a longitudinal direction; and the guide section of the nozzle is located centrally with respect to the penetration holes.

4. The fuel return valve according to claim 3, wherein said guide section is provided with a slope slanting toward a straight line proceeding direction of fuel discharged through said penetration holes.

5. The fuel return valve according to claim 3, wherein the guide section is formed in a cone shape of which the sectional area increases along a straight line proceeding direction of fuel discharged through said penetration holes from said nozzle body.

6. A fuel return system, comprising:

a fuel return valve; and a nozzle, wherein said nozzle is configured and dimensioned to couple with said fuel return valve, said nozzle defining a plurality of holes therethrough, and wherein said nozzle includes a deflector positioned near an exit of said at least one hole such that fuel passing through said holes encounters said deflector, wherein said deflector has a tapered surface leading away from said fuel return valve.

7. The fuel return system of claim 5, wherein each said hole has a cross-sectional area that is reduced as compared to an upstream cross-sectional flow area.

8. The fuel return system of claim 7, wherein said holes are provided in sufficient number to provide a total cross-sectional area greater than the upstream cross-sectional flow area.

* * * * *